United States Patent [19]

Shands

[11] Patent Number: 4,745,642

[45] Date of Patent: May 24, 1988

[54] DISPOSER SAFEGUARD

[76] Inventor: Hazel B. Shands, 465 Calle Retama, Brownsville, Tex. 78520

[21] Appl. No.: 73,196

[22] Filed: Jul. 14, 1987

[51] Int. Cl.[4] ..... A47K 17/00

[52] U.S. Cl. ..... 4/661; 4/287; 4/292; 4/DIG. 4; 15/105; 15/236 R

[58] Field of Search ..... 4/286, 661, 287, DIG. 4, 4/290, 292, 295; 15/105, 236 R, 104; 100/41; 134/115 G; 294/1.1; 241/46 R, DIG. 30, 100.5; 210/164

[56] References Cited

U.S. PATENT DOCUMENTS

| | | | |
|---|---|---|---|
| 2,166,273 | 7/1939 | Ulmar | 4/287 |
| 3,427,636 | 2/1969 | Seifert | 15/236 R X |
| 3,780,393 | 12/1973 | Gaetke | 15/236 R X |
| 4,137,578 | 2/1979 | Felici | 15/105 X |
| 4,268,080 | 5/1981 | Lindley | 15/105 X |
| 4,409,692 | 10/1983 | Ness | 15/236 R X |
| 4,504,996 | 3/1985 | Loos | 4/295 X |

*Primary Examiner*—Henry K. Artis

*Attorney, Agent, or Firm*—Fleit, Jacobson, Cohn & Price

[57] ABSTRACT

A safety device for protecting ones' hands while stuffing waste material into the comminuting chamber of a powered disposer having its comminuting chamber aligned with a drain passage enclosed by a flanged sleeve depending from the sink basin through its drain opening and from which the powered disposed is suspended. An axially elongated plunger body of the safety device extends through the drain passage into the comminuting chamber while supported by its apertured cover plate resting on the flange of the sleeve thereby spacing the lower impaction end from the disposer cutter blades.

7 Claims, 1 Drawing Sheet

DISPOSER SAFEGUARD

BACKGROUND OF THE INVENTION

This invention relates generally to powered waste disposal units installed below kitchen sinks or the like and, more particularly, to means for ensuring safe use of such powered disposal units.

Kitchen sink installed waste or garbage disposal units within which waste material is ground by powered rotation of a cutting head, within a comminuting chamber of the unit axially spaced below and in axial alignment with the drain opening of the sink, are well known, as disclosed by way of example in U.S. Pat. Nos. 2,879,949 to Jordan and 4,135,258 to Braga et al. Drain stoppers and strainers for sinks are also generally well known, as disclosed by way of example in U.S. Pat. Nos. 2,166,273; 2,263,537; and 3,570,022 to Ulmer, Frederickson, and Mealy, respectively. The use of sink drain stoppers in association with waste or garbage disposal units installed therebelow are also well known, as disclosed, for example, in U.S. Pat. Nos. 2,670,143 to Jordan and 2,879,949 to Jordan aforementioned. However, the disposal intake control arrangements associated with the related prior art arrangements, as aforementioned, are incapable of providing the necessary safety measure to prevent injury to a relatively small hand of a person, such as a child's hand, while attempting to force waste material into an operating powered disposal unit. The protective cap arrangements associated with the prior art arrangements, as aformentioned, serve only to reduce upward splashing of liquids and particles during the waste grinding operation and will not, for example, prevent a child from plunging his or her hand into the grinding blades of the disposal unit by removal of the cap, in order to ensure that the waste material is being ground up.

In the use of the conventional sink mounted garbage disposal unit, particularly by children and older people having diminished eyesight and limited use of the hands because of various handicaps and/or physical conditions, the displacement of food scraps and other waste materials into the disposer through the sink drain passage becomes a problem. The protective drain cap and/or strainer usually provided is often removed because of food scraps and other wastes that are blocked from entry into the drain passage. Such food scraps and waste material are then stuffed into the drain passage, often while the powered disposal unit is in operation, by use of the hands to create the aforementioned safety problem, particularly for children and elderly people unable to gauge unsafe entry distance of the hands into the drain passage which is in communication with the comminuting chamber of the disposal unit.

It is, therefore, an important object to provide a safety device for use in connection with sink mounted, powered disposal units which will overcome the aforementioned safety problems.

A further object of the present invention in accordance with the foregoing object is to provide a protective safety device which will enable all persons to utilize sink mounted disposal units without the aforementioned dangers attendant thereto.

SUMMARY OF THE INVENTION

In accordance with the present invention, a drain-closing cap dimensionally larger than the drain opening in the sink is provided with a holding knob on one axial side and an axially elongated waste displacing plunger body on the other axial side, adapted to be inserted into the drain passage for displacing food scraps and other waste materials thereinto, either prior to or during operation of the powered disposal unit. Water or liquid draining holes are formed in an apertured plate portion of the drain-closing cap, which is provided with a peripheral support surface seated on the flange of a sleeve which depends from the bottom of the sink basin through its drain opening. The plunger body is configured to enable displacement of food scraps and waste into the drain passage and to be received therein while supported on the peripheral support surface of the drain-closing cap, with its lower impaction end spaced with sufficient clearance from the grinding blades within the comminuting chamber of the disposal unit to avoid interference with its operation.

The plunger body of the disposer safety device in order to meet the aforementioned objectives of the invention is made of a rigid material and has a smooth external surface of variable diameter with a cross-sectionally enlarged portion of maximum diameter terminated by the lower impaction end aforementioned. Such enlarged portion of the plunger is connected by a reduced diameter neck portion to a plate portion of the drain-closing cap.

BRIEF DESCRIPTION OF THE DRAWING FIGURES

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF PREFERRED EMBODIMENT

Figure 1:
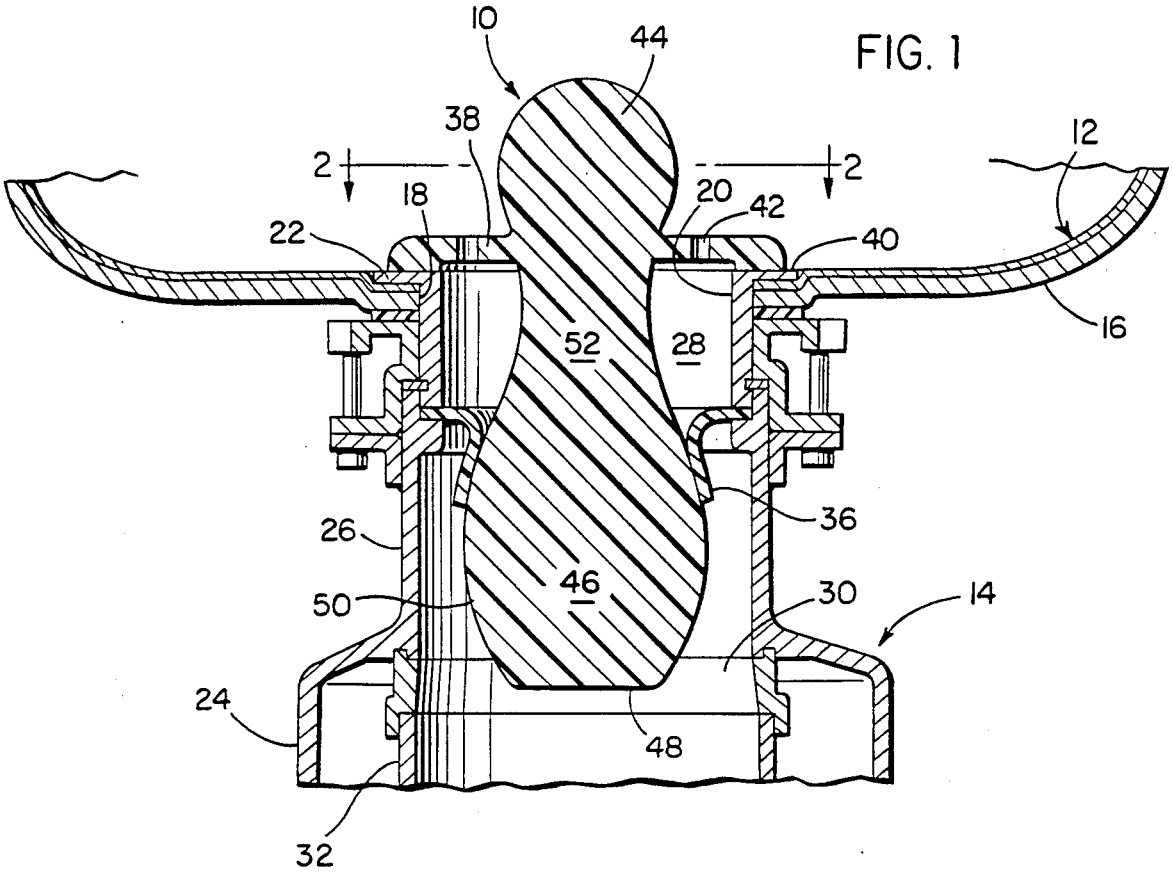
FIG. 1 is a side section view through a sink mounted waste disposal unit with the safety device of the present invention disposed therein.
Figure 3:
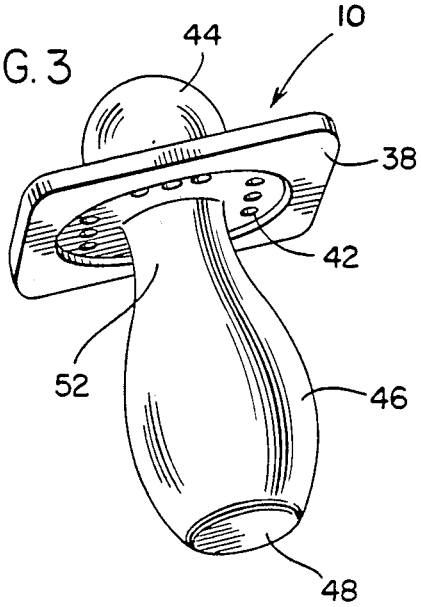
FIG. 3 is a perspective view of the safety device of the present invention itself.

Referring now to the drawing in detail, the safety device of the present invention generally referred to by reference numeral 10, as shown in FIGS. 1 and 3, is shown in FIG. 1 supported in its usual position within a sink generally referred to by reference numeral 12 to which any conventional type of powered, waste disposal unit 14 is attached.

The sink 12 is of the usual type, having a sink basin 16 made of the usual material and formed with a drain opening 18. A flanged sleeve 20 depends from the sink basin through the drain opening with its annular flange portion 22 secured to the sink basin and bordering the drain opening on top thereof. The waste disposal unit 14 has an outer casing generally referred to by reference numeral 24 with an upper inlet portion 26 attached to the lower end of the sink sleeve 20. The sleeve 20 and upper inlet portion 26 of the disposer casing 24 thus form a drain passage 28 through which water and food scraps pass into a comminuting chamber 30 enclosed within the waste disposal unit 14, as is well known in the art. The waste disposal unit thus mounts a rotatable powered cutter or grinding head projecting into the comminuting chamber 30 for grinding of waste material mixed with water therein. A mixture of ground solids and liquid is accordingly discharged from the disposal unit.

The drain passage 28 aforementioned has a throat section of minimum flow diameter. In certain installations, the throat section of the drain passage is provided with an anti-splash, flexible baffle 36. Flexible segments of such baffle are displaced downwardly during the displacement of food scraps and waste materials into the comminuting chamber. The baffle 36 in its underformed condition prevents the upward displacement of liquid and small solid particles. In accordance with the present invention, such anti-splash baffle is held deformed, as shown in FIG. 1, by the safety device 10 when seated in position, as shown.

Figure 2:
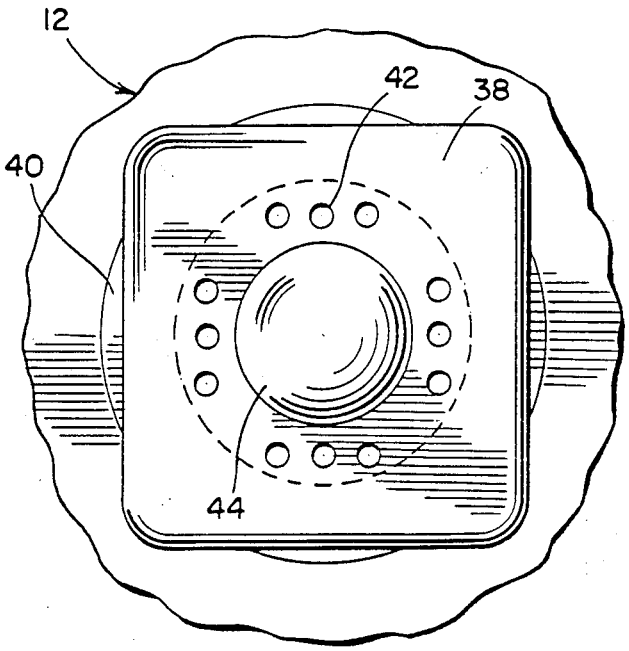
FIG. 2 is a transverse section view taken substantially through a plane indicated by section line 2—2 in FIG. 1.

The safety device 10, in accordance with the illustrated embodiment, may be made in one piece from a rigid plastic material. The device includes a drain cover portion which includes an apertured plate member 38 of generally rectangular shape as more clearly seen in FIG. 2. The plate member supports the device in its quiescent position, as shown in FIG. 1, by means of a peripheral supporting surface 40 on its underside. Such supporting surface 40 rests on the flange portion 22 of the sink sleeve 20. The plate member 38 will accordingly be disposed within the sink above the drain opening to cover the same. A plurality of drain holes 42 are formed in the plate member in order to permit the drainage of liquid into the drain passage 28, while at the same time blocking the insertion of a person's fingers or hands into the drain passage. The drain holes 42 are accordingly located radially between the support surface 22 and a knob formation 44 projecting centrally and upwardly from the plate member so as to facilitate removal of the safety device 10 from its rest position, as shown in FIG. 1.

Projecting from the drain cover plate 38 downwardly in an axial direction opposite to that of the knob 44 is a plunger body, generally referred to by reference number 46. The plunger body has an externally smooth surface in the illustrated embodiment and a longitudinal axis which extends through the knob 44 in axial alignment therewith. The lower end of the plunger body 46 has a planar impaction end surface 48. The plunger body is dimensioned so that the axial distance from the plate member 38 to the impaction end surface 48 is such as to leave an axial clearance distance from the cutter blades of grinder head 32 within the comminuting chamber 30 so as to avoid interference with operation of the disposal unit. The impaction end surface 48 terminates a cross-sectionally enlarged portion 50 of the plunger body, having a maximum diameter which is, nevertheless, less by a clearance amount from the internal wall surfaces of the drain passage 28 at its minimum diameter throat section so as to enable slidable insertion and withdrawal of the safety device 10. The cross-sectionally enlarged portion 50 of the plunger body is connected by a reduced diameter neck portion 52 to the drain cover plate member 38. When inserted into the drain passage 28, the safety device 10 will accordingly downwardly deflect the flexible sections of the anti-splash baffle 36, as shown in FIG. 1.

From the foregoing description, use of the safety device will be apparent. The safety device may be withdrawn from its rest position, as shown in FIG. 1, in order to displace any food scraps and other waste material that collects within the sink basin into the drain passage 28 without the direct use of a person's hands or fingers to push such food scraps into the drain passage. In fact, holding the device 10 by means of its knob 44 will protect the hand from the drain passage because of the blocking action of the cover plate member 38. Further, the plunger body 46 may be utilized to stuff the food scraps through the drain passage into the comminuting chamber 30, without any danger to the hands of the user during operation of the disposal unit and without interference with such operation, since the drain cover plate 38 will limit the extent to which the plunger body 46 is inserted into the comminuting chamber 30.

The foregoing is considered as illustrative only of the principles of the invention. Further, since numerouas modifications and changes will readily occur to those skilled in the art, it is not desired to limit the invention to the exact construction and operation shown and described and accordingly, all suitable modifications and equivalents may be resorted to, falling within the scope of the invention.

What is claimed is:

1. In combination with a sink having a drain opening and a flanged sleeve depending from the sink through the drain opening, a waste disposer suspended from said sleeve, including a grinding head and a casing enclosing a comminuting chamber within which the grinding head is exposed, said casing having an upper inlet portion attached to the sleeve to form therewith a drain passage of varying diameter between the drain opening and the comminuting chamber and having a throat section above the comminuting chamber at which the diameter is minimum, a device for controlling insertion of waste material into the comminuting chamber through the drain passage, comprising a protective cover seated on the flanged sleeve within the sink and covering the drain opening, an axially elongated body of variable diameter depending from the cover through the drain passage into the comminuting chamber, said body having: (a) a lower impaction end surface axially spaced by a clearance distance from the grinding head during support of the body within the comminuting chamber by the cover, (b) a cross-sectionally enlarged portion of maximum diameter terminated by said impaction end surface and (c) a neck portion of reduced diameter connecting the enlarged portion to the cover, said enlarged portion of the body having a dimensional passage clearance relationship to the throat section of the drain passage.

2. The combination of claim 1 wherein the cover includes a plate member having a peripheral support surface seated on the flanged sleeve above the drain opening in surrounding relation to the neck portion of the body and a knob projecting centrally upwardly from the plate member, said plate member having openings formed therein radially between the knob and the peripheral support surface.

3. The combination of claim 2 including a flexible, anti-splash baffle projecting inwardly from the throat section of the drain passage under deflected contact with the body.

4. The combination of claim 1 including a flexible, anti-splash baffle projecting radially inwardly from the throat section of the drain passage under deflected contact with the body.

5. For use in a drain passage between a sink and a waste disposer suspended therefrom, a device for displacing waste material through the drain opening into the drain passage into the disposer and protectively covering the drain opening of the drain passage within the sink, comprising an apertured drain cover dimensioned larger than the drain passage in cross-section, and an axially elongated plunger body projecting from and composite with the cover, said body having an impaction end axially remote from the cover, a cross-sectionally enlarged portion of maximum diameter terminated by said impaction end and a neck portion of reduced diameter connecting the enlarged portion to the cover.

6. The device as defined in claim 5 wherein said cover includes a plate member connected to the neck portion of the body and extending radially therefrom beyond the enlarged portion of the body and a knob projecting centrally from the plate member in a direction opposite to that of the body.

7. The device as defined in claim 6 wherein the plate member includes a peripheral contact surface radially spaced from the neck portion of the body connected thereto and a plurality of drain holes formed in the plate member radially between the contact surface and the neck portion of the body.

* * * * *